US006406134B1

(12) United States Patent
Hu et al.

(10) Patent No.: US 6,406,134 B1
(45) Date of Patent: Jun. 18, 2002

(54) MONOLITHIC INK-JET PRINT HEAD AND METHOD OF FABRICATING THE SAME

(75) Inventors: Je-Ping Hu, Lu-Chou; Yi-Yung Wu, Taichung; Daniel Y. Lan, Hsinchu Hsien; Yi-Hsuan Lai, Hsinchu; Hui-Fang Wang, Taichung Hsien, all of (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/235,643

(22) Filed: Jan. 22, 1999

(30) Foreign Application Priority Data

Jul. 28, 1998 (TW) ..... 87112300 A

(51) Int. Cl.[7] ..... B41J 2/16
(52) U.S. Cl. ..... 347/65; 216/27; 430/320
(58) Field of Search ..... 347/63, 65, 47; 29/890.1; 216/27, 2; 430/320

(56) References Cited

U.S. PATENT DOCUMENTS 4,389,654 A * 6/1983 Bar-on et al. ..... 347/75
4,437,100 A * 3/1984 Sugitani et al. ..... 347/65
4,558,333 A * 12/1985 Sugitani et al. ..... 347/65
4,882,595 A * 11/1989 Trueba et al. ..... 347/85
5,030,317 A * 7/1991 Noguchi ..... 156/630
5,229,785 A * 7/1993 Leban ..... 347/47
5,334,999 A * 8/1994 Kashiwazaki et al. ..... 347/65
5,410,341 A * 4/1995 Sugahara et al. ..... 347/69
5,453,769 A * 9/1995 Schantz et al. ..... 347/63
5,582,678 A * 12/1996 Komuro ..... 216/27
5,945,260 A * 8/1999 Miyagawa et al. ..... 430/320
6,162,589 A * 12/2000 Chen et al. ..... 430/320

FOREIGN PATENT DOCUMENTS

JP 403000255 * 1/1991

* cited by examiner

*Primary Examiner*—John Barlow
*Assistant Examiner*—Blaise Mouttet
(74) *Attorney, Agent, or Firm*—J.C. Patents

(57) ABSTRACT

A monolithic ink-jet print head and a method of fabricating the same are proposed, which not only can allow the nozzle device to be highly secured to the ink-jet print head, but also can allow the overall manufacturing process for the ink-jet print head to be more simplified and thus more cost-effective to implement as compared to the prior art. The monolithic ink-jet print head is constructed on a print-control chip formed with an array of transducers. A plurality of ink barrier layers are then formed from a first polymer over the print-control chip for separating the transducers from each other; and subsequently, a nozzle device is formed from a second polymer over the ink barrier layer. The second polymer is substantially equal or at least close in thermal expansion coefficient to the first polymer used to form the ink barrier layer. Therefore, the nozzle device would hardly break apart from the ink barrier layer after a long period of use that would easily occur in the prior art due to repeated unequal thermal expansions during operation. Moreover, the monolithic process to fabricate the ink-jet print head also allows the manufacture of the ink-jet print head to be easily carried out for mass production with reduced manufacturing cost simply through conventional semiconductor fabrication processes.

15 Claims, 2 Drawing Sheets

MONOLITHIC INK-JET PRINT HEAD AND METHOD OF FABRICATING THE SAME

CROSS-REFERENCE TO RELATED APPLICATION

This application claims the priority benefit of Taiwan application serial no. 87112300, filed Jul. 28, 1998, the full disclosure of which is incorporated herein by reference.

BACKGROUND OF THE INVENTION

1. Field of the Invention

This invention relates to ink-jet printer technology, and more particularly, to a monolithic ink-jet print head and a method of fabricating the same.

2. Description of Related Art

Ink-jet printers, due to low prices and high-quality print outputs, are very popular in the printer market. An ink-jet printer uses a print head that includes an ink transducer, such as a heater, to heat liquid ink into droplets and then spray the droplets onto paper. One popular type of ink-jet print head is the so-called top shooter, which includes a nozzle device mounted on a print-control chip.

Patents related to the ink-jet printer technology include, for example, the U.S. Pat. No. 4,913,405, which utilizes a laser cutting method to make a nozzle device for ink-jet print head; and the U.S. Pat. No. 4,791,436, which utilizes an electroforming method to make a nozzle device for ink-jet print head.

FIG. 1 is a schematic sectional diagram showing the structure of a conventional ink-jet print head. As shown, this ink-jet print head is composed of two main parts: a print-control chip 10 and a nozzle device 16. The print-control chip 10 includes an array of transducers 12 and a plurality of barrier layers 14 for separating the transducer means 12 from each other. Each of the transducers 12 can be a heater or a piezoelectric device, which is used to heat liquid ink into droplets for spraying onto the paper. The nozzle device 16 is a perforated plate including an array of nozzles 18. By the conventional method, the nozzle device 16 is a separate component that is fabricated separately aside the print-control chip 10. In assembly, the nozzle device 16 is then mounted on the print-control chip 10 by first aligning the nozzles 18 in the nozzle device 16 with the corresponding transducers 12 on the print-control chip 10, and then pressing the nozzle device 16 (while heating the barrier layers 14) against the barrier layers 14 by a pressing force indicated by the arrow 22 so as to attach the nozzle device 16 in the direction indicated by the arrows 20 onto the barrier layers 14. When mounted in position, the nozzles 18 in the nozzle device 16 should be accurately aligned with the corresponding transducers 12 on the print-control chip 10.

In the foregoing ink-jet print head, the nozzle device 16 can be formed either through the laser cutting method of U.S. Pat. No. 4,913,405 or through the electroforming method of U.S. Pat. No. 4,791,436. One drawback to the use of these two methods, however, is that the fabricated nozzle devices would be low in good yield rate since these methods can easily cause the fabricated nozzle devices to be subjected to high stress during fabrication that would then cause formational distortions to the fabricated nozzle devices.

Another drawback is that, during the attachment of the nozzle device 16 to the barrier layers 14, the pressure should be carefully controlled. Otherwise, if overly pressurized, the barrier layers 14 can be distorted in shape that would make them unable to bond the nozzle device 16 securely; and if insufficiently pressurized, the attached barrier layers 14 would easily break apart from the barrier layers 14.

Still another drawback is that, after a long period of use, the nozzle device 16 can nonetheless easily break apart from the print-control chip 10 due to the reason that the nozzle device 16 is typically made of metal, which is significantly higher in thermal expansion coefficient than the barrier layers 14. During the operation of the ink-jet print head, both the nozzle device 16 and the barrier layers 14 will be subjected to heat; therefore, after long period of use, the bonding between the nozzle device 16 and the barrier layers 14 can easily break loose.

From the foregoing description, it can be learned that the conventional method for fabricating an ink-jet print head is difficult and thus costly to carry out, which makes the fabricated ink-jet print head less competitive on the market. Moreover, the utilization of the ink-jet print head is also cost-ineffective since the nozzle device would be individually mounted on the barrier layers.

SUMMARY OF THE INVENTION

It is therefore an objective of the present invention to provide a monolithic ink-jet print head and a method of fabricating the same, which can integrate the nozzle device with the print-control chip so that the overall manufacturing cost of the ink-jet print head can be reduced as compared to the prior art.

It is another objective of the present invention to provide a monolithic ink-jet print head and a method of fabricating the same, which can allow the nozzle device to be highly affixed to the print-control chip without having the possibility of detaching from the print-control chip due to poorly controlled pressing.

It is still another objective of the present invention to provide a monolithic ink-jet print head and a method of fabricating the same, which can allow the nozzle device to be reliably affixed to the print-control chip without having the possibility of detaching from the print-control chip due to the nozzle device being significantly higher in thermal expansion coefficient than the barrier layers.

It is still another objective of the present invention to provide a monolithic ink-jet print head and a method of fabricating the same, which can allow the nozzle device to be reliably affixed to the print-control chip without having an adhesive material.

In accordance with the foregoing and other objectives of the present invention, an ink-jet print head and a method of fabricating the same are provided.

The monolithic ink-jet print head is constructed on a print-control chip formed with an array of transducers. An ink barrier layer is then formed from a first polymer over the print-control chip for separating the transducers from each other; and subsequently, a nozzle device is formed from a second polymer over the ink barrier layer.

The second polymer is substantially equal or at least close in thermal expansion coefficient to the first polymer used to form the ink barrier layer. Therefore, the nozzle device would hardly break apart from the ink barrier layer after a long period of use that would easily occur in the prior art due to repeated unequal thermal expansions during operation. Moreover, the monolithic process to fabricate the ink-jet print head also allows the manufacture of the ink-jet print head to be easily carried out for mass production with reduced manufacturing cost through conventional semiconductor fabrication processes.

BRIEF DESCRIPTION OF DRAWINGS

The invention can be more fully understood by reading the following detailed description of the preferred embodiments, with reference made to the accompanying drawings, wherein.

DETAILED DESCRIPTION OF PREFERRED EMBODIMENTS

The invention provides a monolithic ink-jet print head and a method of fabricating the same, which allows the nozzle device to be integrated with the print-control chip and features that the nozzle device is formed from a polymeric material that is substantially equal or at least close in thermal expansion coefficient to the material used to form the ink barrier layers.

FIGS. 2A–2E are schematic sectional diagrams used to depict the steps involved in a preferred embodiment of the method of the invention for fabricating a monolithic ink-jet print head.

Figure 1:
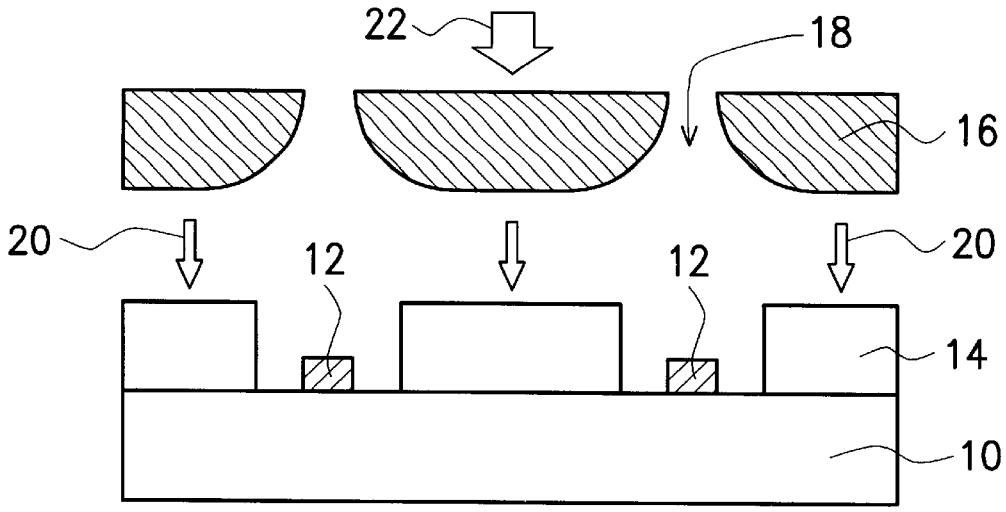
FIG. 1 (PRIOR ART)
FIG. 1 is a schematic sectional diagram showing the structure of a conventional ink-jet print head.
Figure 2A:
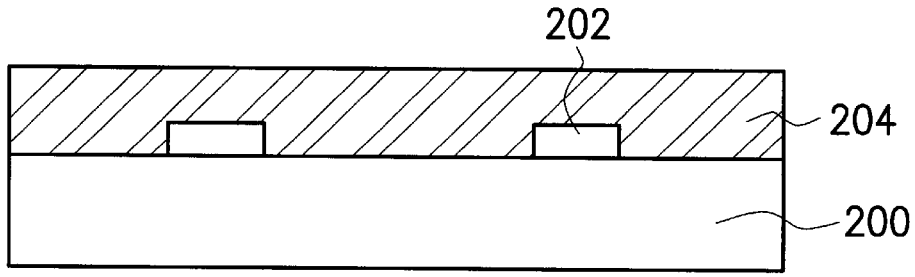
FIGS. 2A–2E are schematic sectional diagrams used to depict the steps involved in the method of the invention for fabricating a monolithic ink-jet print head.

Referring first to FIG. 2A the monolithic ink-jet print head of the invention is constructed on a print-control chip 200. The print-control chip 200 is identical in functionality and inside structure as that used in the prior art, so description thereof will not be further detailed. An array of transducers 202 is then mounted on the print-control chip 200, which can be a heater or a piezoelectric device used to heat liquid ink into droplets for spraying onto the paper being printed. The transducers 202 are identical in functionality and inside structure as those used in the prior art, so description thereof will also not be further detailed.

In the next step, a first polymer layer 204, such as a photoresist layer or a dry film, is coated over the print-control chip 200 through a spin-coating or a rolling process to a thickness of from 5 $\mu$m to 200 $\mu$m (micrometer) to cover all of the exposed surfaces of the print-control chip 200 and the transducers 202. The first polymer layer 204 can be either a positive photoresist or a negative photoresist. In this preferred embodiment, the first polymer layer 204 is a negative photoresist.

Figure 2B:
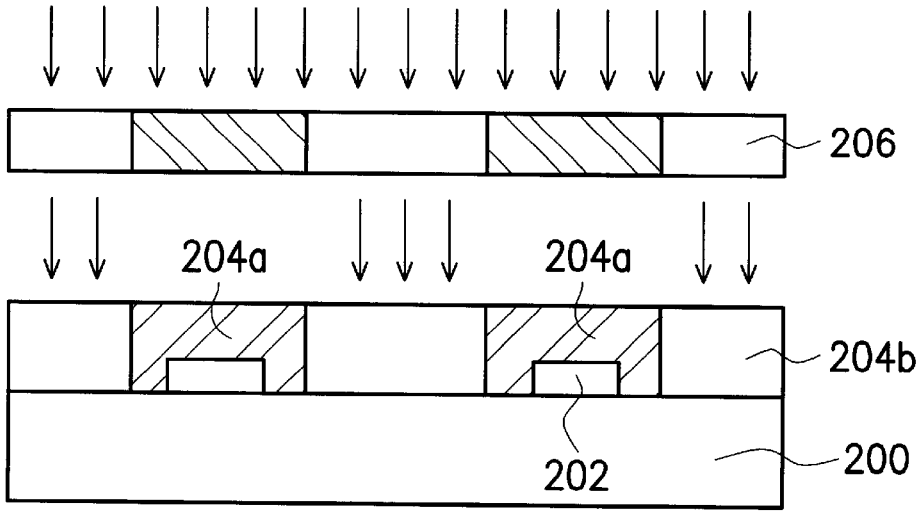

Referring next to FIG. 2B, in the subsequent step, a photolithographic process is performed on the first polymer layer 204 with a predefined mask 206. Since the first polymer layer 204 is a negative photoresist in this preferred embodiment, the mask 206 is prepared in such a manner as to mask those portions of the first polymer layer 204 (as indicated by the reference numeral 204*a*) that are predefined to be formed into ink channels and chambers, and unmask those portions of the first polymer layer 204 (as indicated by the reference numeral 204*b*) that are predefined to be formed into ink barrier layers. If the first polymer layer 204 is positive type, the masked and unmasked portions are simply interchanged. The ink chambers are the void spaces where the transducers 202 are housed, while the ink channels are the void spaces used to guide ink to the transducers 202.

Figure 2C:
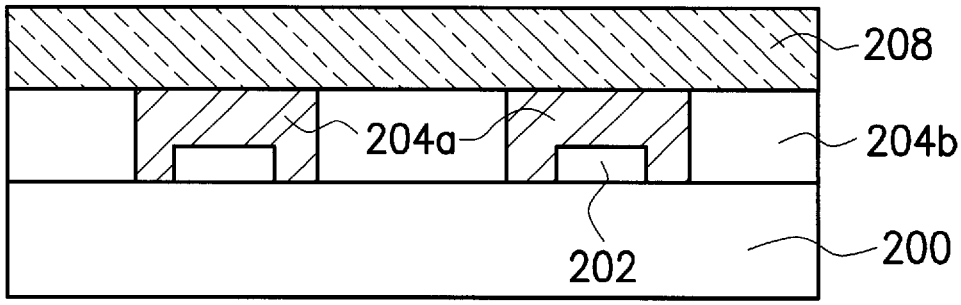

Referring further to FIG. 2C, in the subsequent step, a second polymer layer 208 is deposited through either a spin-coating or a rolling process to a thickness of from 5 $\mu$m to 200 $\mu$m over the entire top surface of the first polymer layer 204 including the light-unexposed portions 204*a* and the light-exposed portions 204*b*. In accordance with the invention, the second polymer layer 208 is formed from a material that is substantially equal to or close in thermal expansion coefficient to the first polymer layer 204, which can be selected from the group consisting of polyimide, polystyrene, polycarbonate, polymethylmethacrylate, epoxy, novolac, polyester, and polysulfone.

Figure 2D:
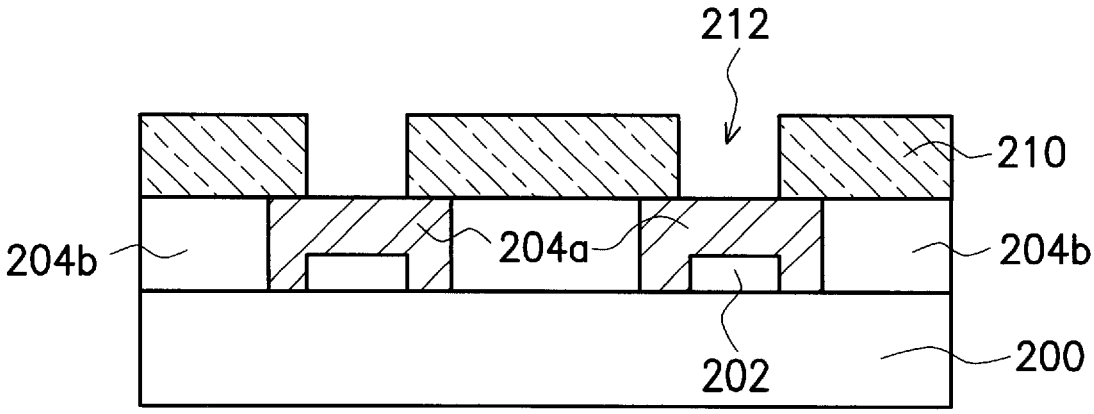

Referring next to FIG. 2D, in the subsequent step, a selective removal process is performed on the second polymer layer 208 (shown in FIG. 2C) to form an array of nozzles 212 therein, each being aligned to the corresponding one of the transducers 202 on the print-control chip 200. The remaining part of the second polymer layer 208 then serves as the desired nozzle device and is hereinafter designated instead by the reference numeral 210 for distinguishing purpose. The selective removal process can be, for example, a dry-etching process, a wet-etching process, or a laser-cutting process.

Figure 2E:
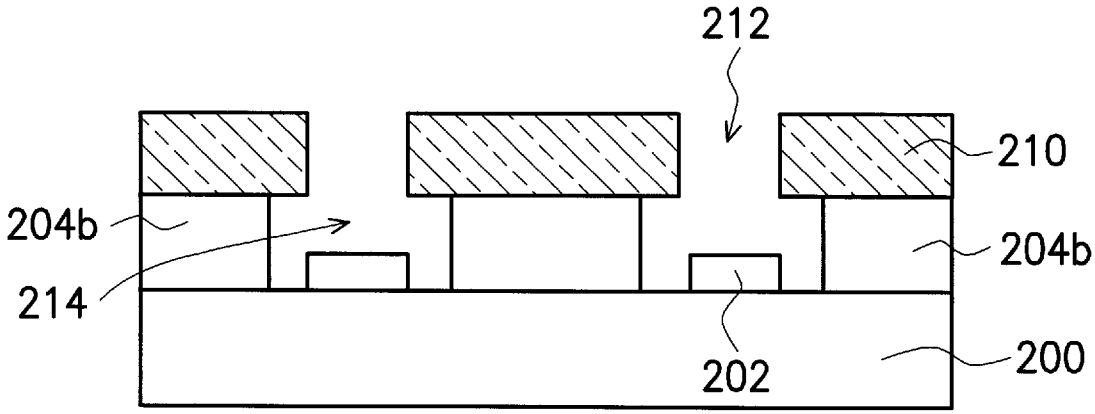

Referring next to FIG. 2E, in the subsequent step, the unexposed portions 204*a* of the first polymer layer 204 are entirely removed by using a developer. The left-behind void portions 214 then serve as ink chambers and channels, with the ink chambers being used to house the transducers 202 and the ink channels being used to guide ink to the transducers 202. The remaining solid portions of the first polymer layer 204, i.e., the light-exposed portions 204*b*, then serve as ink barrier layers between the transducers 202. This completes the fabrication of the monolithic ink-jet print head of the invention.

In addition, there can be further forming an adhesive layer on the print-control chip 200 or between the first and the second polymer layers 204, 208.

In conclusion, the invention provides a monolithic ink-jet print head and a method of fabricating the same, which allows the nozzle device 210 to be integrated with the print-control chip 200. This feature not only allows the nozzle device 210 to be highly secured to the ink-jet print head, but also allows the overall manufacturing process for the ink-jet print head to be more simplified as compared to the prior art.

Moreover, since the nozzle device 210 is formed from a selected polymeric material that is substantially equal or close in thermal expansion coefficient to the material used to form the ink barrier layers 204*b*, the nozzle device 210 would hardly break apart from the ink barrier layers 204*b* after a long period of use that would easily occur in the prior art due to repeated unequal thermal expansions during operation.

Still moreover, since the invention is monolithic, it allows the manufacture of the ink-jet print head to be easily carried out for mass production with reduced manufacturing cost simply through conventional semiconductor fabrication processes.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A method for fabricating a monolithic ink-jet print head, comprising the steps of:

preparing a print-control chip;

forming an array of transducers over the print-control chip;

forming a first polymer layer over the print-control chip, covering all the exposed surfaces of the print-control chip and the transducers;

defining a selected part of the first polymer layer as ink barrier layers, with all the other part of the first polymer layer to be subsequently removed to serve as ink chambers and channels;

after defining the first polymer layer, forming a second polymer layer over the first polymer layer, with the second polymer layer being substantially equal in thermal expansion coefficient to the first polymer layer;

performing a selective removal process to remove those portions of the second polymer layer that are directly aligned to the transducers to thereby form an array of nozzles in the second polymer layer, with the remaining part of the second polymer layer serving as a nozzle device; and removing those portions of the first polymer layer that are laid directly beneath the nozzles in the nozzle device, with the left-behind void portions serving as the ink channels and chambers and the remaining solid portions of the first polymer layer serving as the ink barrier layers between the transducers.

2. The method of claim 1, wherein the first polymer layer is formed from a photo-sensitive material.

3. The method of claim 2, wherein the photo-sensitive material is a positive photoresist.

4. The method of claim 2, wherein the photo-sensitive material is a negative photoresist.

5. The method of claim 2, wherein the photo-sensitive material is a dry film.

6. The method of claim 1, wherein the second polymer layer is formed from a polymeric material selected from the group consisting of polyimide, polystyrene, polycarbonate, polymethylmethacrylate, epoxy, novolac, polyester, and polysulfone.

7. The method of claim 1, wherein the first and second polymer layers are each formed through a spin-coating process.

8. The method of claim 1, wherein the first and second polymer layers are each formed through a rolling process.

9. The method of claim 1, wherein the first polymer layer is formed to a thickness of from 5 $\mu$m to 200 $\mu$m.

10. The method of claim 1, wherein the second polymer layer is formed to a thickness of from 5 $\mu$m to 200 $\mu$m.

11. The method of claim 1, wherein the selective removal process is a laser-cutting process.

12. The method of claim 1, wherein the selective removal process is a dry-etching process.

13. The method of claim 1, wherein the selective removal process is a wet-etching process.

14. The method of claim 1, further forming an adhesive layer on the print-control chip.

15. The method of claim 1, further forming an adhesive layer between the first and the second polymer layers.

* * * * *